US006196547B1

(12) United States Patent
Pascal et al.

(10) Patent No.: US 6,196,547 B1
(45) Date of Patent: Mar. 6, 2001

(54) PLAY STRATEGY FOR A COMPUTER OPPONENT IN A ELECTRONIC CARD GAME

(75) Inventors: Andrew Pascal, Burlingame; John Kelly, San Jose; Sharon Glusker, Belmont; Mark Nicely, San Francisco; Robert (Eagle) Burns, Palo Alto, all of CA (US)

(73) Assignee: Silicon Gaming - Nevada, Las Vegas, NV (US)

( * ) Notice: Subject to any disclaimer, the term of this patent is extended or adjusted under 35 U.S.C. 154(b) by 0 days.

(21) Appl. No.: 09/247,441

(22) Filed: Feb. 10, 1999

Related U.S. Application Data

(60) Provisional application No. 60/074,525, filed on Feb. 12, 1998.

(51) Int. Cl.[7] ..... A63F 1/00

(52) U.S. Cl. ..... 273/292; 273/139; 463/13; 463/26

(58) Field of Search ..... 273/292, 139; 463/13, 16, 20

(56) References Cited

U.S. PATENT DOCUMENTS

| | | | | |
|---|---|---|---|---|
| 4,836,553 | * | 6/1989 | Suttle et al. | 273/292 |
| 4,948,134 | * | 8/1990 | Suttle et al. | 273/85 CP |
| 5,022,653 | * | 6/1991 | Sttlle et al. | 273/85 CP |
| 5,118,109 | * | 6/1992 | Gumina | 273/139 |
| 5,380,012 | | 1/1995 | Jones et al. | 273/292 |
| 5,382,025 | | 1/1995 | Sklansky et al. | 273/292 |
| 5,732,950 | * | 3/1998 | Moody | 273/292 |
| 5,816,916 | * | 10/1998 | Moody | 463/13 |
| 5,941,770 | * | 8/1999 | Miers et al. | 463/13 |
| 5,964,464 | * | 10/1999 | Jones | 273/292 |

* cited by examiner

*Primary Examiner*—Jeanette Chapman
*Assistant Examiner*—D Collins
(74) *Attorney, Agent, or Firm*—Claude A. S. Hamrick; Justin F. Boyce; Oppenheimer Wolff & Donnelly LLP

(57) ABSTRACT

A process of dealing and drawing cards is provided wherein a player hand including N cards is dealt to the player from a computer card deck. An opponent hand including N cards is dealt to the opponent from the deck. The player and the opponent are provided with opportunity to draw cards. A gaming system determines which cards of the initial opponent hand to hold and which to discard using a play strategy-lookup table in accordance with the present invention. The strategy look-up table is addressed using an address set including all possible hands that could be dealt in an N card poker game. Each address of the address set stores a corresponding optimal hold scenario which provides information indicating which of the particular N cards of a hand to hold and which to discard in order have the greatest probability of winning. Cards are discarded from the initial opponent hand according to the look up table. A replacement card is dealt to the computer opponent from the deck for each card discarded from the opponent hand. The final opponent hand, including the final card values are then revealed and a winning hand is determined.

16 Claims, 17 Drawing Sheets

PLAY STRATEGY FOR A COMPUTER OPPONENT IN A ELECTRONIC CARD GAME

This application claims benefit to Provisional Application No. 60/074,525 filed Feb. 12, 1998.

FIELD OF THE INVENTION

The present invention relates generally to electronic card games. Specifically, the present invention relates to a banked electronic card game wherein a player plays against at least one computer opponent which plays according to an optimal game strategy when drawing cards.

DESCRIPTION OF THE PRIOR ART

Electronic card gaming systems and processes are well known in the prior art. Such gaming systems typically include a computer processor for executing game instructions, a computer readable memory for storing the instructions and data, a computer monitor for displaying cards and related images, and a player interface. In such systems, the card game is a computer implemented process. Such gaming systems may also include logic circuits dedicated to implementing the card game.

Typically, in electronic card games, an initial player hand including a number of cards, having corresponding card values, is dealt to a player with the card values being displayed on a display unit. Typically, the player is provided with an opportunity to draw a number of cards by selecting which cards of the initial player hand to hold and which to discard. Discarded cards are replaced with new cards, having new values, to develop a final player hand. Eventually, the player hand is evaluated and a payout is made. Evaluation of the player hand may be made by solely evaluating the card values of the player hand, by comparing the final player hand to that of another user-player, or by comparing the final player hand to that of a computer opponent which employs a strategy based on a set of strategy rules.

Some prior art electronic card games are used in casino gaming wherein the player wagers against the house or against other players. Where players plays against the house, the game is referred to as a banked game. In prior art banked electronic card games, a computer opponent is dealt an initial opponent hand and is provided with an opportunity to draw a number of cards by selecting which cards of the initial opponent hand to hold and which to discard. In such prior art systems, the computer opponent selects which cards of the initial opponent hand to hold and which to discard based on a simple set of dealer draw rules which do not guarantee that the computer opponent will play optimally. Some such systems may assume that the sub-optimal play of the computer opponent approximately matches the sub-optimal play of the average human player. However, without additional measures, if a computer opponent does not play optimally, a player employing an optimal strategy would enjoy an advantage over the house. To prevent this, one prior art system employs additional wagering rules, which are not included in traditional card games to make the playing of the game more advantageous to the house. However, such untraditional wagering rules make the game more difficult for a player to understand how the game is played and therefore make the game less appealing to a player familiar only with standard draw poker For example, in U.S. Pat. No. 4,848,134, filed Nov. 27, 1989, entitled "Electronic Poker Game", if the banker has less than an Ace-King combination, the banker cannot play further and each remaining player is paid one to one odds based on only his ante. The player does not receive any payment for his additional wager, or bet, which the player had to risk in order to advance to that point in the game. If the banker has at least an Ace-King combination and the player wins, then the player collects his additional bet. In this manner, the sub-optimal play of the banker is compensated to make the game more advantageous to the house.

What is needed is a method and apparatus for playing a banked draw poker card game wherein a computer opponent plays optimally and wherein no additional wagering rules are required to make the playing of the game more advantageous to the house.

What is also needed is a card gaming process which allows a player to play against multiple computer opponents.

What is further needed is a card gaming process wherein the player plays a card game as a bonus round to a primary game.

SUMMARY OF THE INVENTION

It is therefore an object of the present invention to provide a process of implementing optimal game strategy for discarding and drawing cards on behalf of a computer opponent in an electronic card game Briefly, a presently preferred embodiment of the present invention includes a process of implementing a draw poker game played between a player and a computer opponent in an electronic card gaming system including processing means, display means, and player interface means. Cards, having card values, are dealt from an imaginary card deck which is typically implemented using a random number generator (RNG). In accordance with the present invention, an initial player "hand" including N cards, is dealt to the player from the imaginary deck, each of the cards having a card value which is displayed on the display means. An initial opponent hand including N cards is then dealt face down to the computer opponent from the imaginary deck with only card backs visible to the player. The player and the computer opponent are provided with opportunity to draw cards. The gaming system allows for the player to "draw" cards by implementing steps including: allowing the player to select certain cards to hold, and other cards to discard, from the player hand using the player interface means; dealing a card to the player from the imaginary deck for each discarded card; and displaying the card values of the present player hand via the display unit.

The gaming system determines which cards of the initial opponent hand to hold and which to discard using a play strategy-lookup table in accordance with the present invention. The look-up table is addressed using an address set including all possible hands that could be dealt in an N card poker game. Each address of the address set stores a corresponding optimal hold scenario which provides information indicating which of the particular N cards of a given opponent hand to hold and which to discard in order have the greatest probability of winning. Cards are discarded from the initial opponent hand according to the look up table. A replacement card is dealt to the computer opponent from the deck for each card discarded from the initial opponent hand to develop a final opponent hand which is later revealed and a winning hand is determined.

A process of creating various play strategy look-up tables is provided. All possible hands that could be dealt in an N card poker game are determined. All possible hold scenarios are determined for each of the possible hands. An "expected payback value" is determined, based on optimal play strategy for the game, for each of the possible hold scenarios. A game designer sets a computer opponent efficiency target value expressed as a percentage of optimal play strategy, wherein the efficiency target value is representative of a level of expertise with which the computer opponent is to play. The hold scenario with a corresponding expected payback value closest to the efficiency target value is determined for each of the possible hands. The look-up table is created wherein the look-up table includes, for each of the possible hands, a hold scenario closest to the computer opponent efficiency target value.

In the preferred embodiment, the card game is draw poker. However, processes of dealing, displaying, and drawing cards in accordance with the present invention may be used in any card game requiring the dealing and drawing of cards. These processes of the present invention may be used in various other embodiments and in combinations of embodiments of various card games. As examples: the draw order may be varied based on whether the player has won a previous game; the player may play against supplementary computer opponents in addition to the one computer opponent; the player may be provided with opportunity to increase a wager or be required to increase his wager either before after the drawing of cards; the player may get an award bonus if his pre-draw hand is of sufficient value; the player may be required to have a qualifying hand in order for the computer opponent to reveal its hand; a card game may be played as a bonus round to a primary game with a bonus pot value as an award; the bonus pot value may be progressively increased over the course of games played; and entry to the bonus round may be conditioned upon the player placing a sufficiently large wager.

An advantage provided by the present invention is that because the computer opponent plays optimally, no additional wagering rules are required to make the playing of the game more advantageous to the house.

An additional advantage is that the minimum theoretical hold can be calculated exactly. Because the computer opponent plays optimally, the minimum theoretical hold can be determined mathematically without having to rely on inexact simulation or real world testing.

The foregoing and other objects, features, and advantages of the present invention will be apparent from the following detailed description of the preferred embodiment which makes reference to the several figures of the drawing.

IN THE DRAWING

Figure 15:
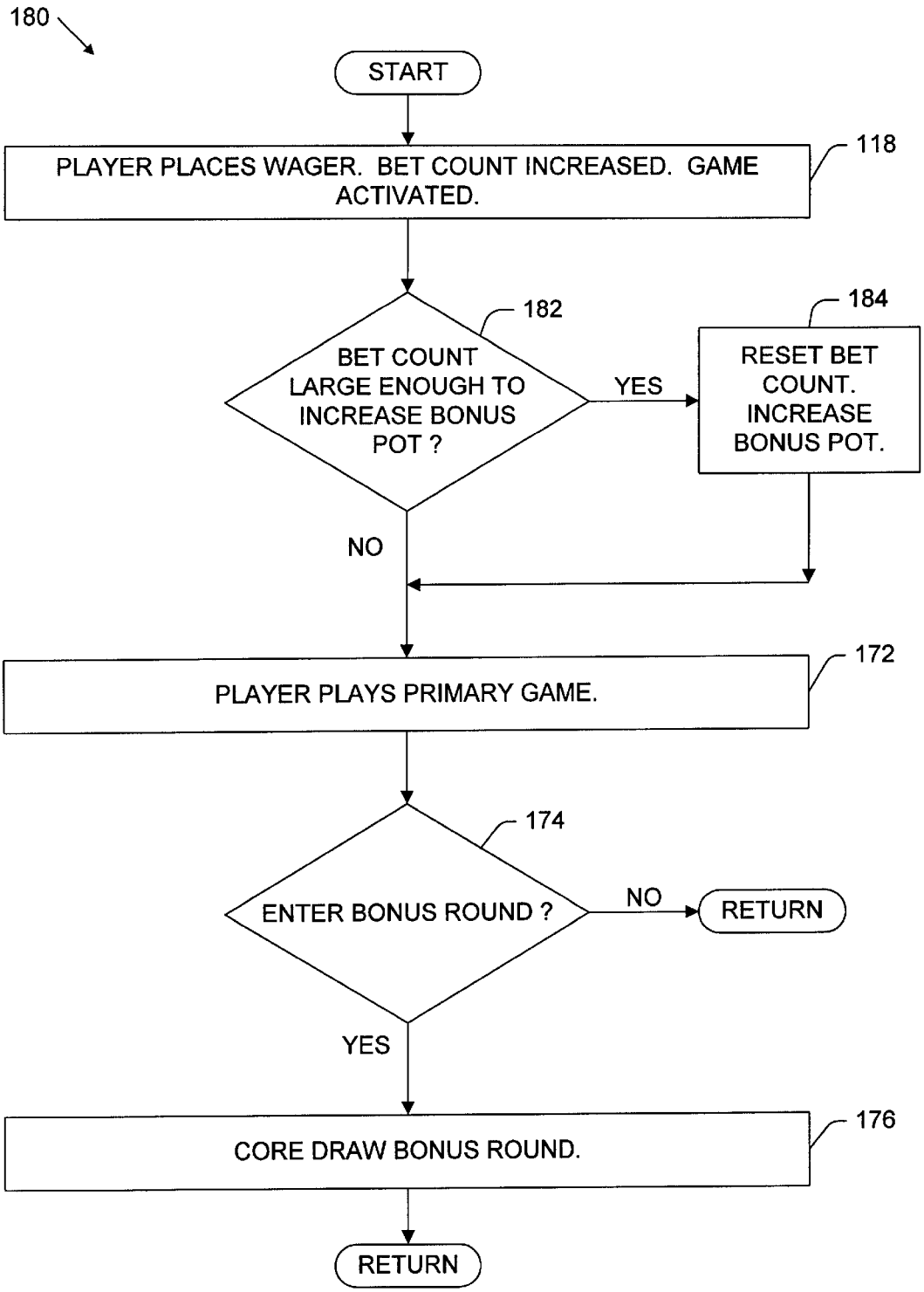
Figure 16:
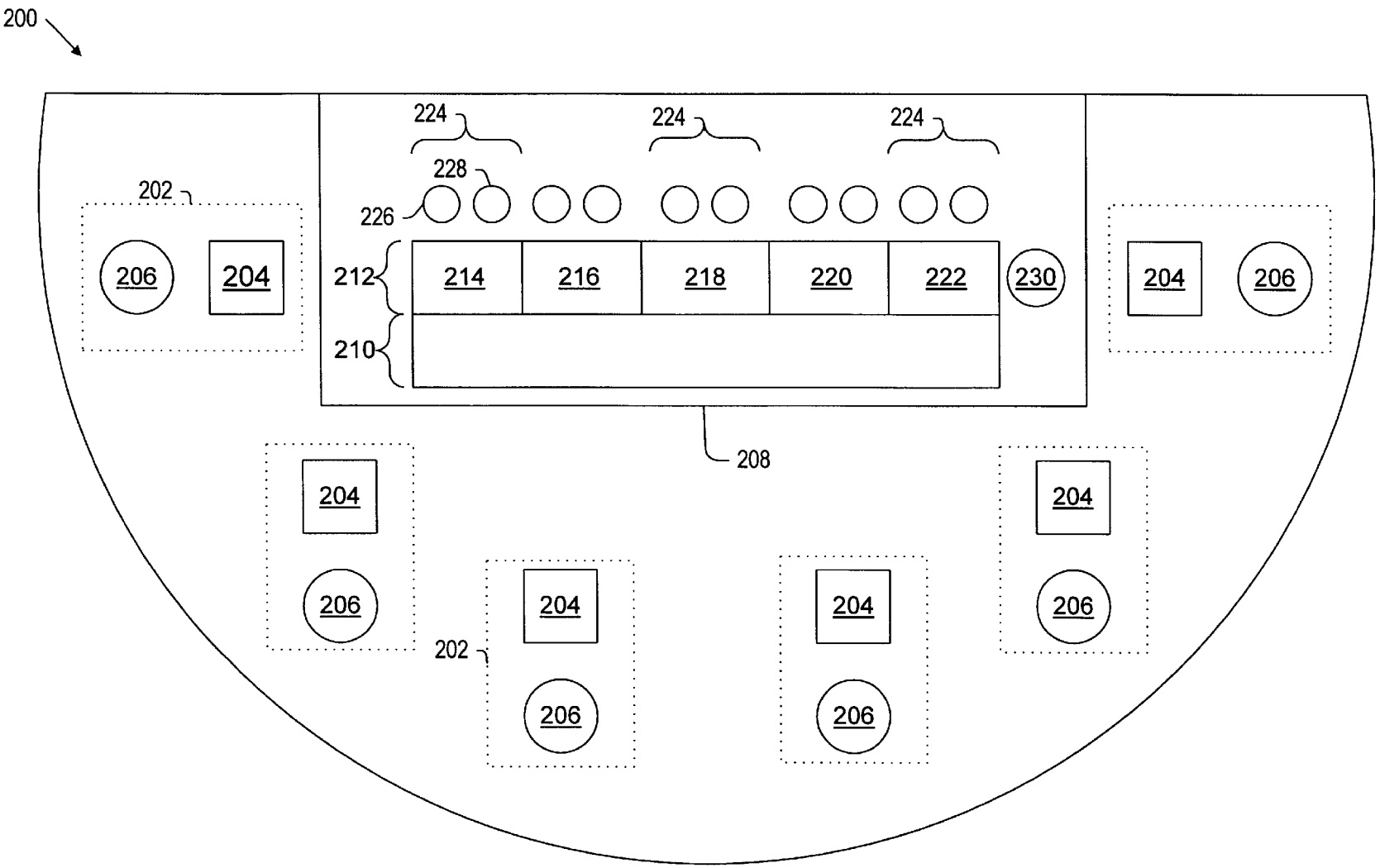

FIG. 15 is a flow chart depicting an electronic card gaming process wherein a bonus round may be entered only if a sufficiently large wager is placed; and FIG. 16 shows a live card-table system 200 according to an embodiment of the present invention for use in implementing a banked card game played with a physical deck of cards wherein a human dealer, whose play is directed by a computer implemented strategy process, plays against one or more players.

DETAILED DESCRIPTION OF THE PREFERRED EMBODIMENTS

Figure 1:
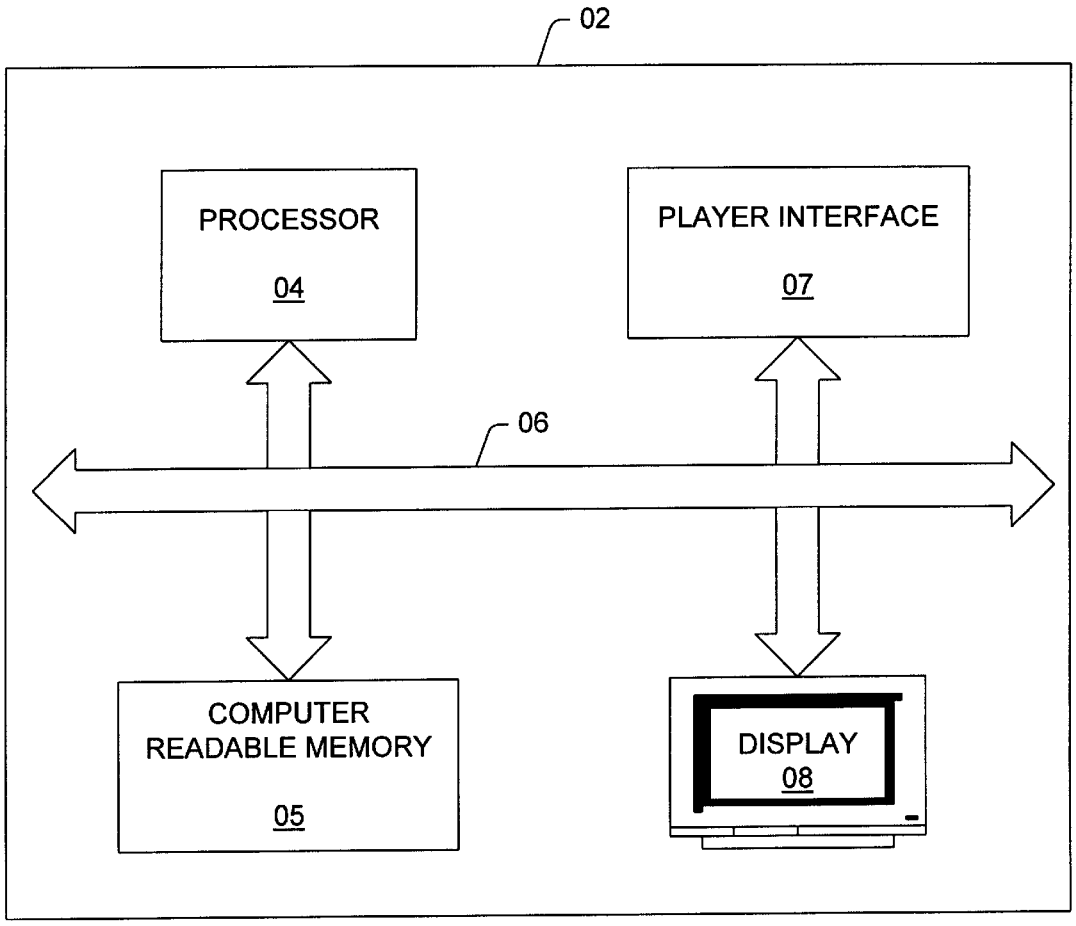
FIG. 1 is a generalized block diagram of an exemplary electronic gaming system for implementing card game processes in accordance with principles of the present invention.

FIG. 1 shows a block diagram of an exemplary computer gaming system 02 for implementing electronic card game processes according to principles of the present invention. In the depicted embodiment, system 02 includes a processor 04 for reading and executing card game instructions, a computer readable memory unit 05, connected to processor 04 via a bus 06, for storing the card game instructions, a player interface 07 connected to bus 06, and a display unit 08. The player interface may include, for example, a "Hold" button for each card dealt to the player. The card game instructions include instructions which, when executed by processor 04, utilize a random number generator (RNG) for generating a set of card values corresponding to the actual card values (and card faces for display) included in one or more computer card decks. In the present invention, the gaming system is said to deal cards, having unique card values, from a "computer card deck" by polling the random number generator. Once a card value is dealt, that value will not be generated again by the RNG unless the RNG is reset, such by "returning the card to the deck" or by restarting the card game.

Figure 2A:
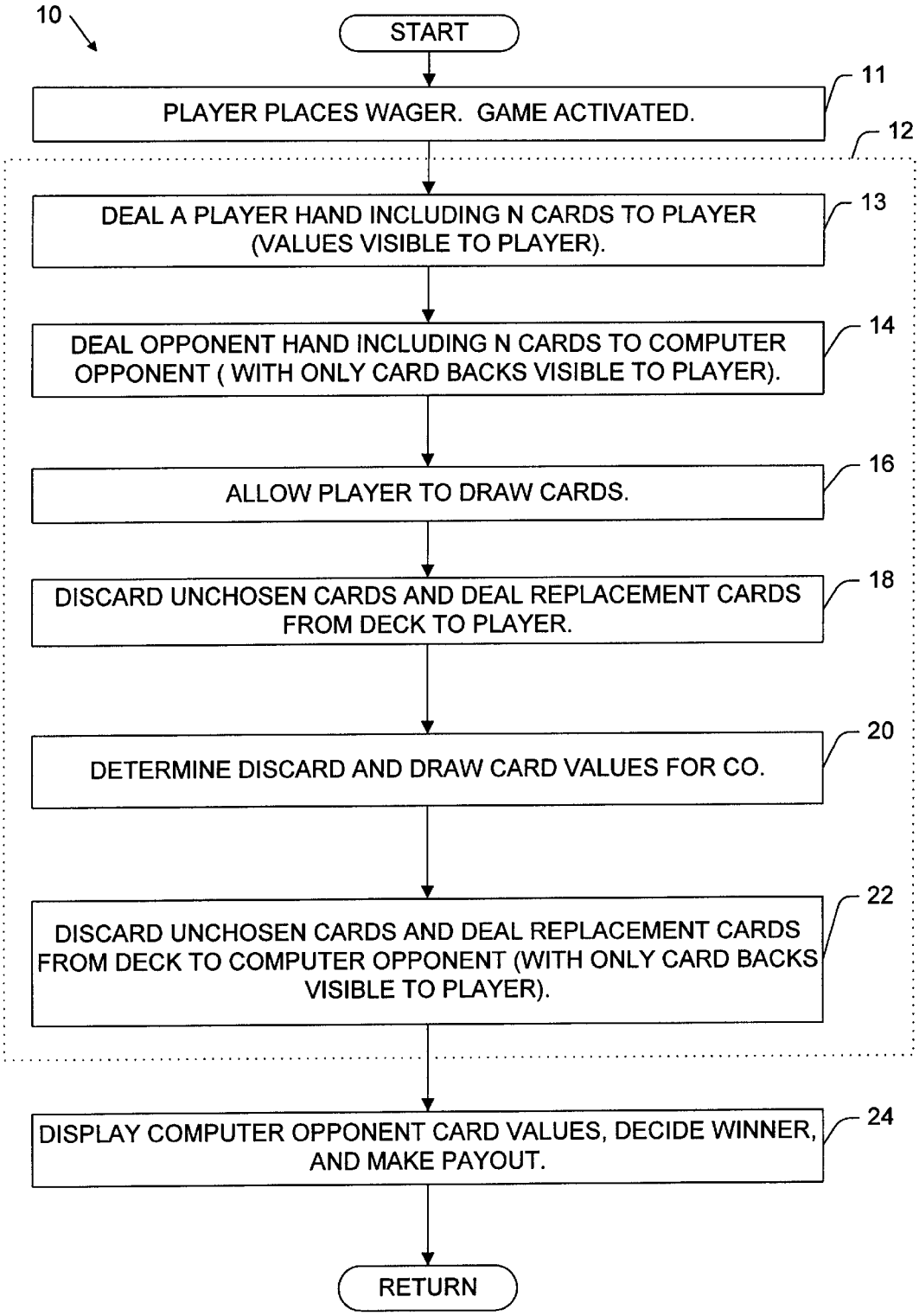
FIG. 2A is a flow chart depicting a process, in accordance with the present invention, for implementing a banked electronic card game played between a player and a computer opponent wherein the computer opponent plays according to an optimal game strategy.

FIG. 2A is a flow chart depicting at 10 a process, in accordance with the present invention, of implementing a banked electronic card game played between a player and a computer opponent wherein the computer opponent plays according to an optimal game strategy. The depicted process begins with step 11 in which a player places a places a wager and the game is activated, and proceeds to implement a core deal sub-process 12 of dealing and drawing cards which includes steps 13, 14, 16, 18, 20, and 22 described below.

Sub-process 12 begins with step 13 in which an initial player hand including N cards, having corresponding card values, is dealt to the player with the card values being displayed on display unit 08 (FIG. 1). In step 14, an initial opponent hand including N cards is dealt to the computer opponent with only card backs visible to the player. In step 16, the player is given an opportunity to draw cards by selecting, via player interface 07 (FIG. 1), which of the N cards of the initial player hand to hold and which to discard. In step 18, unchosen cards are discarded and replacement cards, having other card values, are dealt to the player with the new card values being displayed on display unit 08 (FIG. 1). In step 20, the game system decides which card values of the initial opponent hand to hold and which to discard by addressing a look-up table which is addressed using the N card values of the initial opponent hand as described further below. In step 22, unchosen card values are discarded and new values are generated for replacement "draw" cards which are "dealt" to the computer opponent. After execution of the core-deal sub-process 12, the depicted process proceeds to step 24 in which opponent card values are displayed, a winner is decided, and payout is made.

Figure 2B:
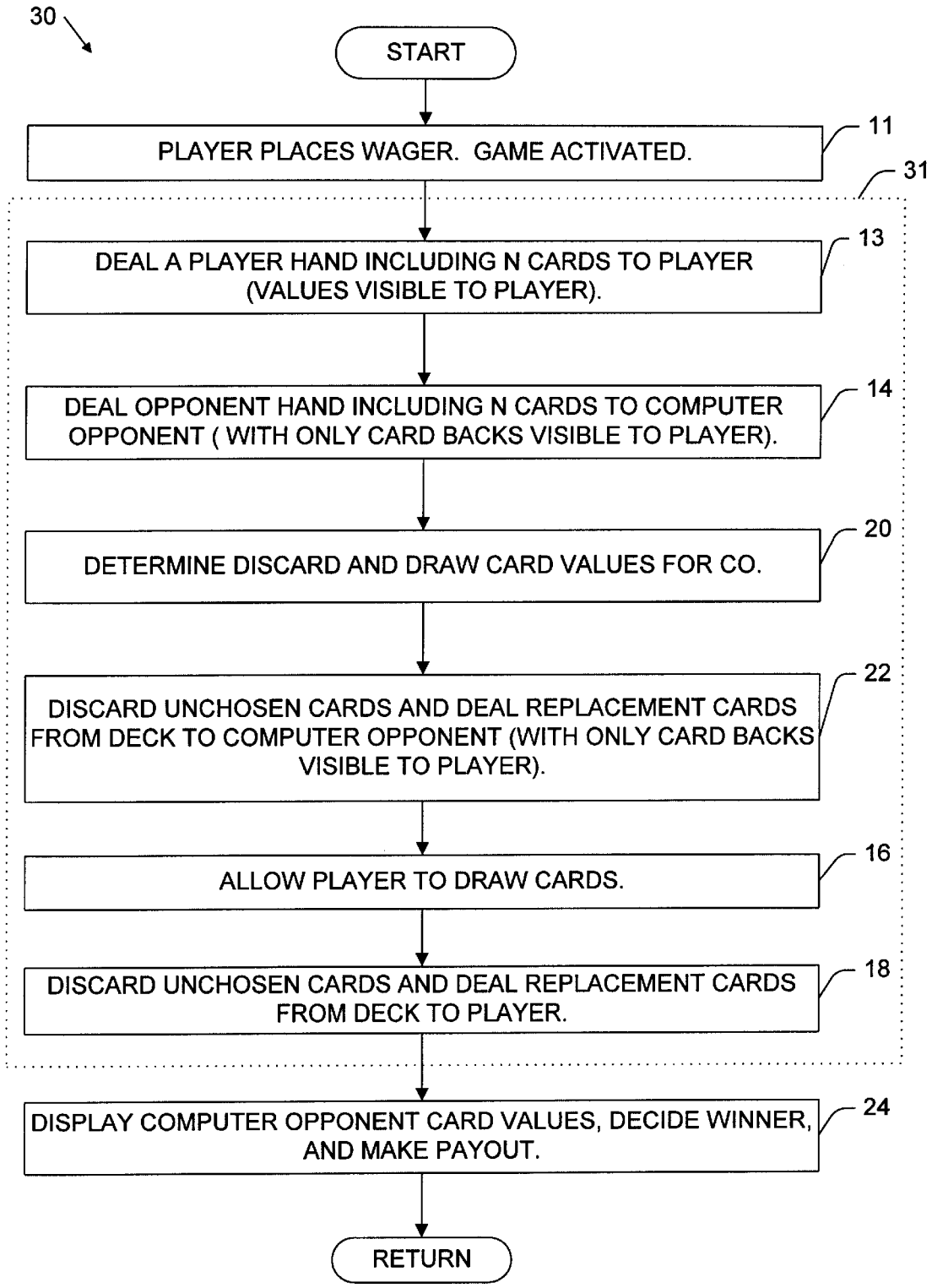
FIG. 2B is a flow chart depicting generally an alternative embodiment of the process illustrated in FIG. 2A wherein the computer opponent draws first.

FIG. 2B depicts at 30 an alternative embodiment of the process illustrated in FIG. 2 wherein the computer opponent draws cards before the player draws. The depicted process is similar to the process illustrated in FIG. 2 except that the core deal sub-process 12 of FIG. 2A is replaced with a core deal sub-process 31 which includes the same steps as sub-process 12 but which executes these steps in a different order. In core deal sub-process 31, steps 20 and 22 are implemented before implementing steps 16 and 18 so that the computer opponent draws before the player.

Figure 3:
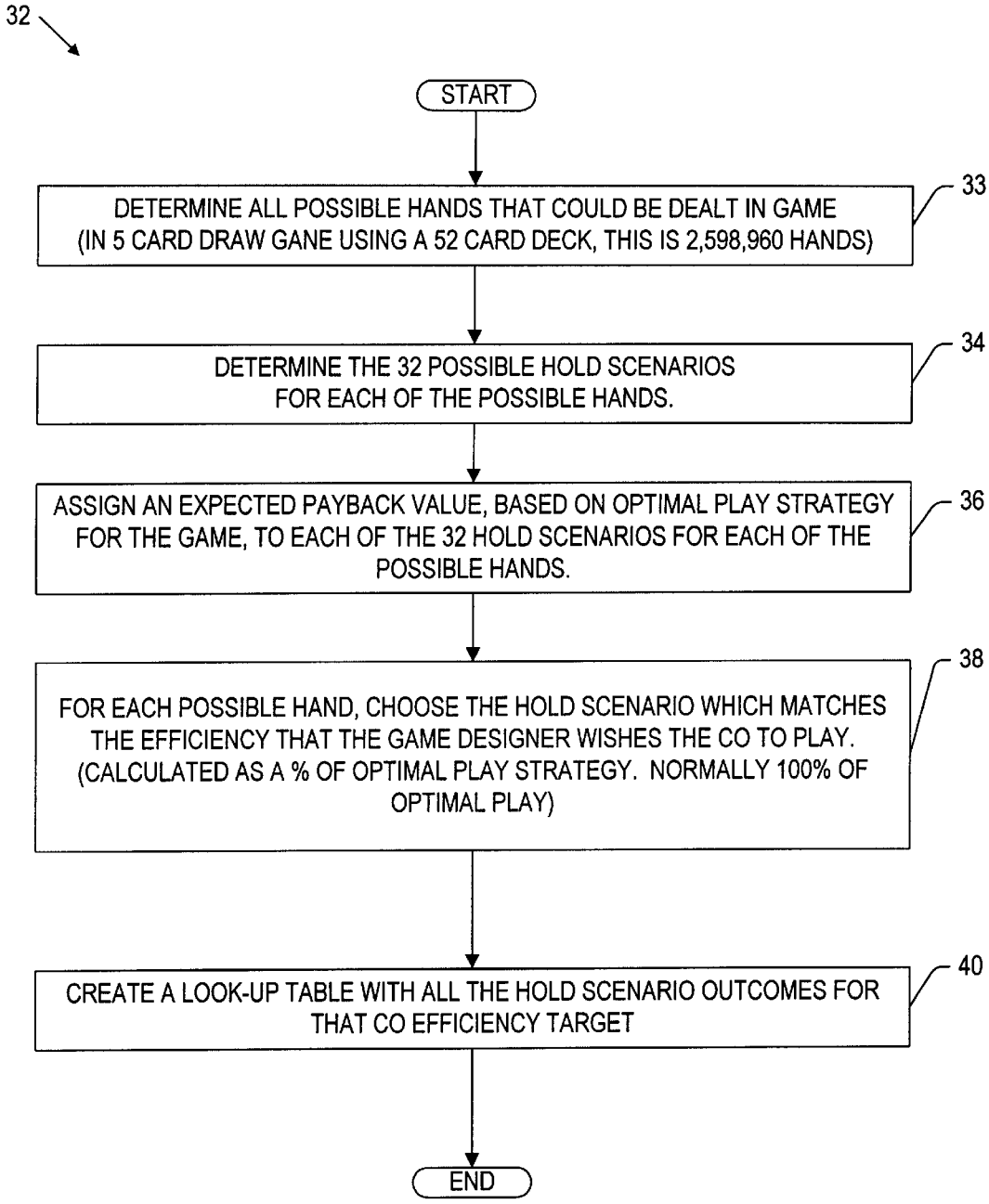
FIG. 3 is a flow chart depicting a process according to the present invention for creating a look-up table for implementing a card game strategy for the computer opponent.

FIG. 3 is a flow chart depicting at 32 a process according to the present invention for creating a play-strategy look-up tables for implementing a draw-poker game strategy for the computer opponent. The depicted process may be implemented by the game system 02 (FIG. 1) or by another computer system. In step 33, all possible hands that could be dealt in an N card poker game are determined. In an embodiment, the card game to be played is five card draw poker using a 52 card deck in which there are 2,598,960 possible hands that could be dealt. In step 34, all possible hold scenarios are determined for each of the possible hands determined in step 32. In the final card draw embodiment, using a 92 card deck, there are 32 possible hold scenarios for each possible hand. In step 36, an "expected payback value" is assigned based on optimal play strategy for the game, to each of the possible hold scenarios, for all the possible hands. The "expected payback value" is defined in U.S. patent application Ser. No. 08/925,094, filed Sep. 8, 1997, entitled "Method for Tabulating Payout Values for Games of Chance" herein incorporated by reference. In step 38, a "computer opponent efficiency target value" is determined. The "computer opponent efficiency target value" is indicative of a level of expertise with which the game designer wishes the computer opponent to play, and is calculated as a percentage of optimal play strategy. In step 40, the hold scenario with the "expected payback value" closest to the "computer opponent efficiency value" is determined for each of the possible hands. In step 42, a look-up table is created wherein the table includes a hold scenario closest to the "computer opponent efficiency target value" for each possible hand. The look-up table is addressable by a set of address values including all possible hands determined in step 32.

Figure 4:
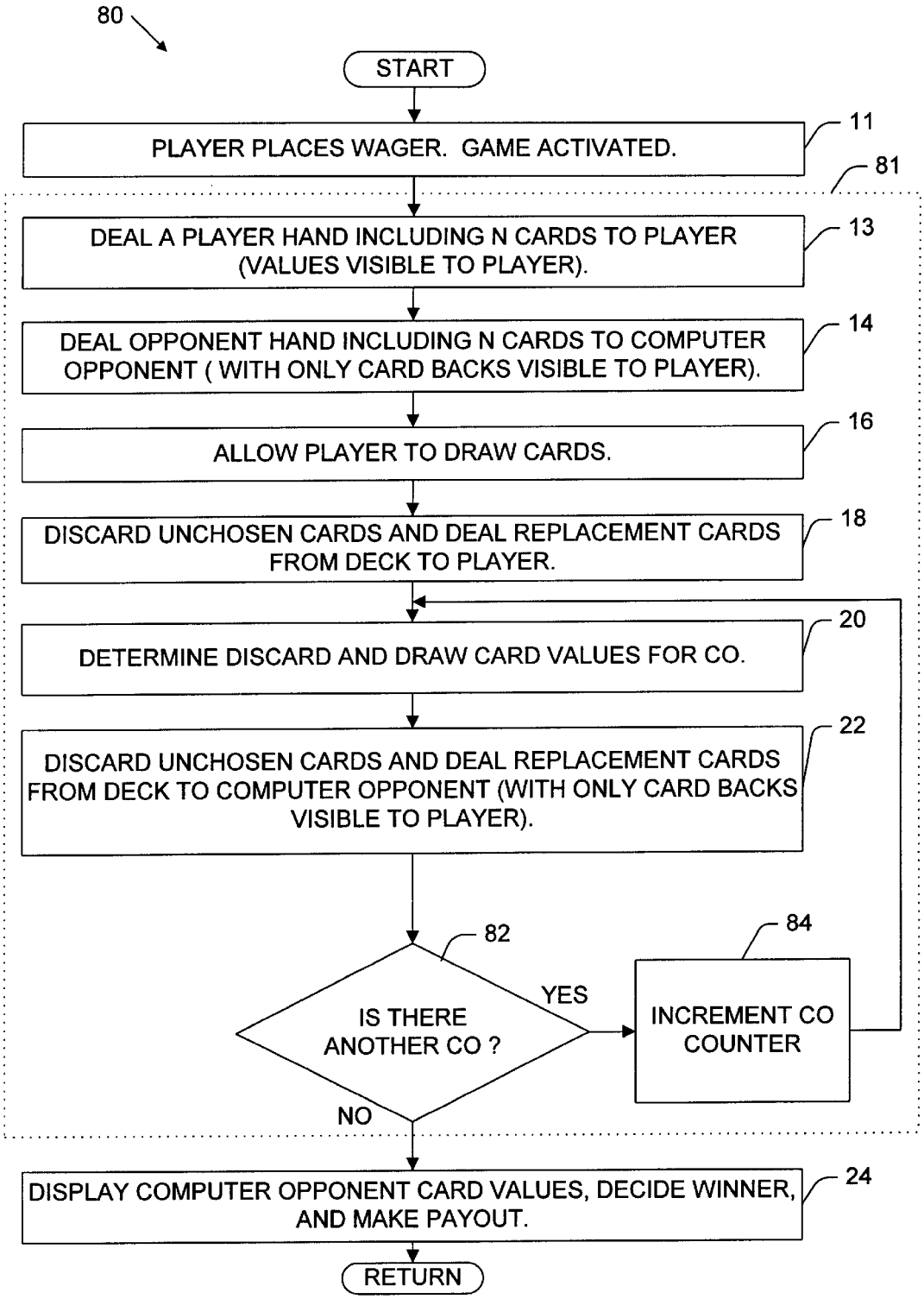
FIG. 4 is a flow chart depicting a variation of the process of FIG. 2A wherein the player plays against multiple computer opponents.

FIG. 4 depicts at 80 an electronic card gaming process played between a player and multiple computer opponents, wherein the player draws first. The depicted process begins with execution of step 11 in which a player places a places a wager, and proceeds to implement a core deal sub-process 81 of dealing and drawing cards which includes steps 13, 14, 16, 18, 20, 22, 82, and 84. The core deal sub-process 81 begins with execution of steps 13 and 14 in which the player hand is dealt to the player and opponent hands are dealt to each computer opponent. The player then draws in steps 16 and 18, as described above. In steps 20 and 22, the card values for the first opponent hand are determined, a draw is effected, and replacement card values are selected for the opponent hand as described above. In step 82, it is determined whether there is another computer opponent. If so, the depicted process proceeds to step 84 in which a computer opponent counter is incremented and then loops back to steps 18 and 20 and a second opponent hand is dealt card values, a draw is effected and replacement card values are selected for the current computer opponent hand. If there is not another computer opponent, a winner is determined and payout is made as described above in reference to FIGS. 2A and 2B, the principal difference being that whether or not the player wins is determined by the hands of more then one computer opponent. Steps 20, 22, and 82 of the process depicted at 80 are repeated for each supplemental computer opponent. The depicted process concludes with execution of step 24 which is described above.

Figure 5:
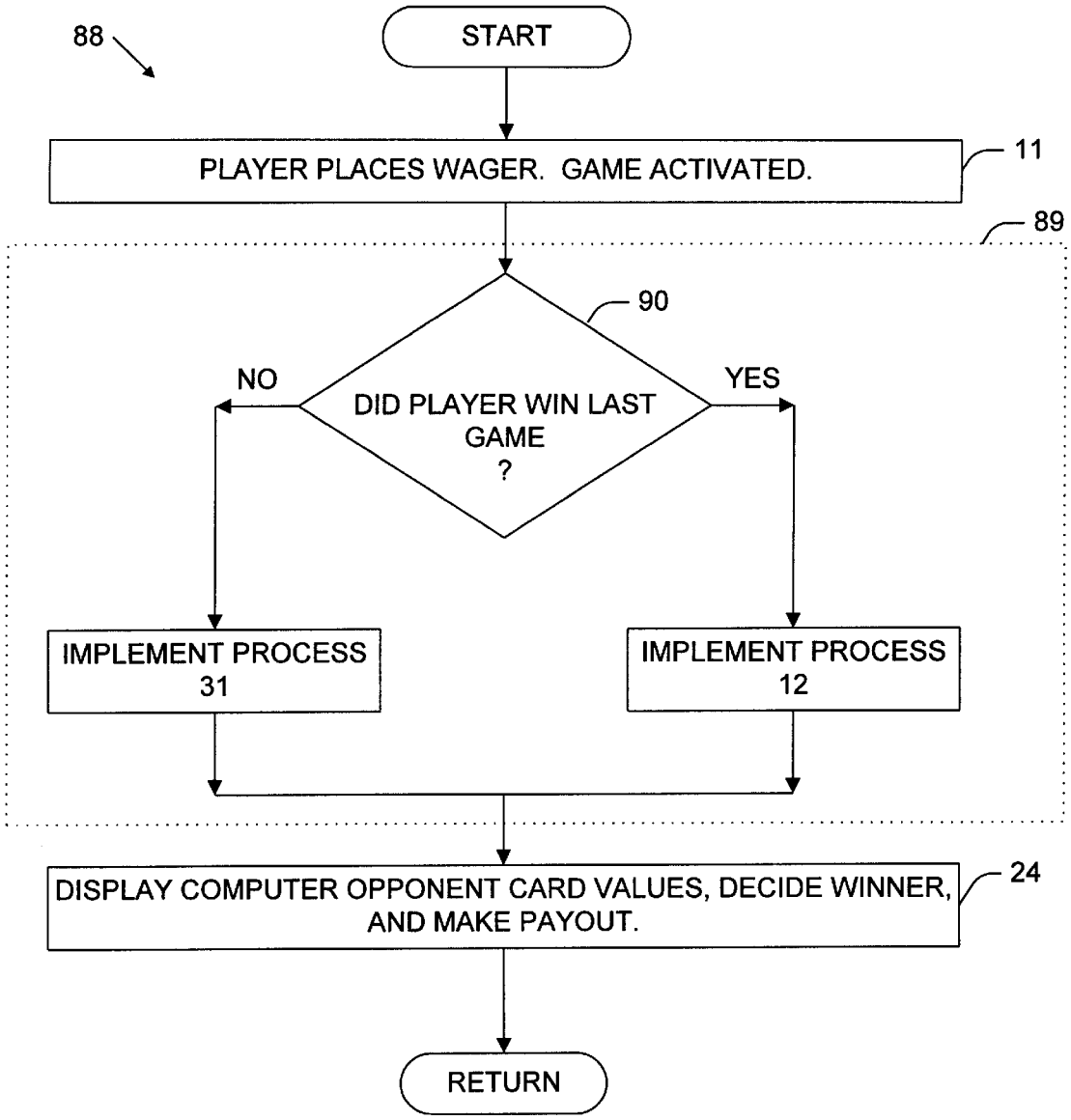
FIG. 5 is a flow chart depicting a variation of the process of FIG. 2A wherein the draw order changes based on whether the player won a previous game.

FIG. 5 illustrates a gaming process wherein the draw order changes based on whether the player won a previous game. The depicted process begins with execution of step 11 in which the player places a wager and the game is activated, and proceeds to implement a core deal sub-process 89 wherein the draw order changes based on whether the player won a previous game. The core deal sub-process 89 begins with step 90 in which it is determined whether the player won a previous game. If so, the depicted game process executes sub-process 12 (FIG. 2A) wherein the player draws first, and after which the depicted process proceeds to execute step 24 as described above. If it is determined in step 90 that the player did not win the previous game, the depicted process executes the sub-process 31 (FIG. 2B) wherein the computer opponent draws first, and after which the depicted process proceeds to step 24 as described above.

Figure 6:
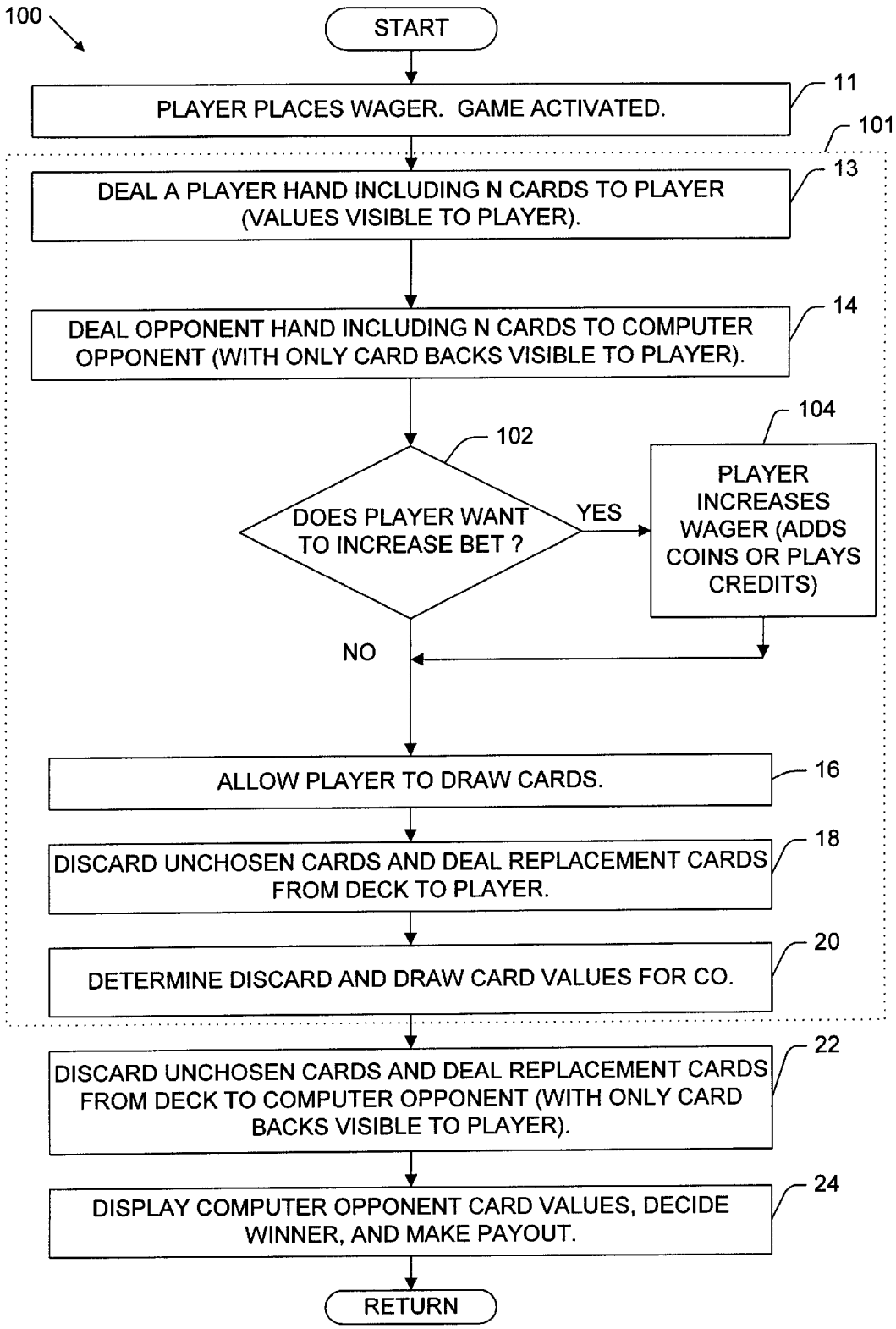
FIG. 6 is a flow chart depicting an electronic card gaming process wherein the player is given an option to increase a wager after the deal but before the player draws.

In the embodiment of FIG. 6, the player is given an option to increase a wager before the player draws. The depicted process begins with execution of step 11 as described above, and proceeds to implement a core deal sub-process 101. Sub-process 101 begins with execution of steps 13 and 14 in which the player hand is dealt to the player and the opponent hand is dealt to the computer opponent as described above. Subsequently, it is determined at step 102 whether or not the player wants to increase the wager, or bet. If so, the player adds coins or applies credits, after which the process proceeds to execute steps 16–22 as described above. If the player does not want to increase the wager, the process proceeds directly to execute steps 16–22 as described above. After execution of sub-process 101, the depicted process executes step 24 as described above.

Figure 7:
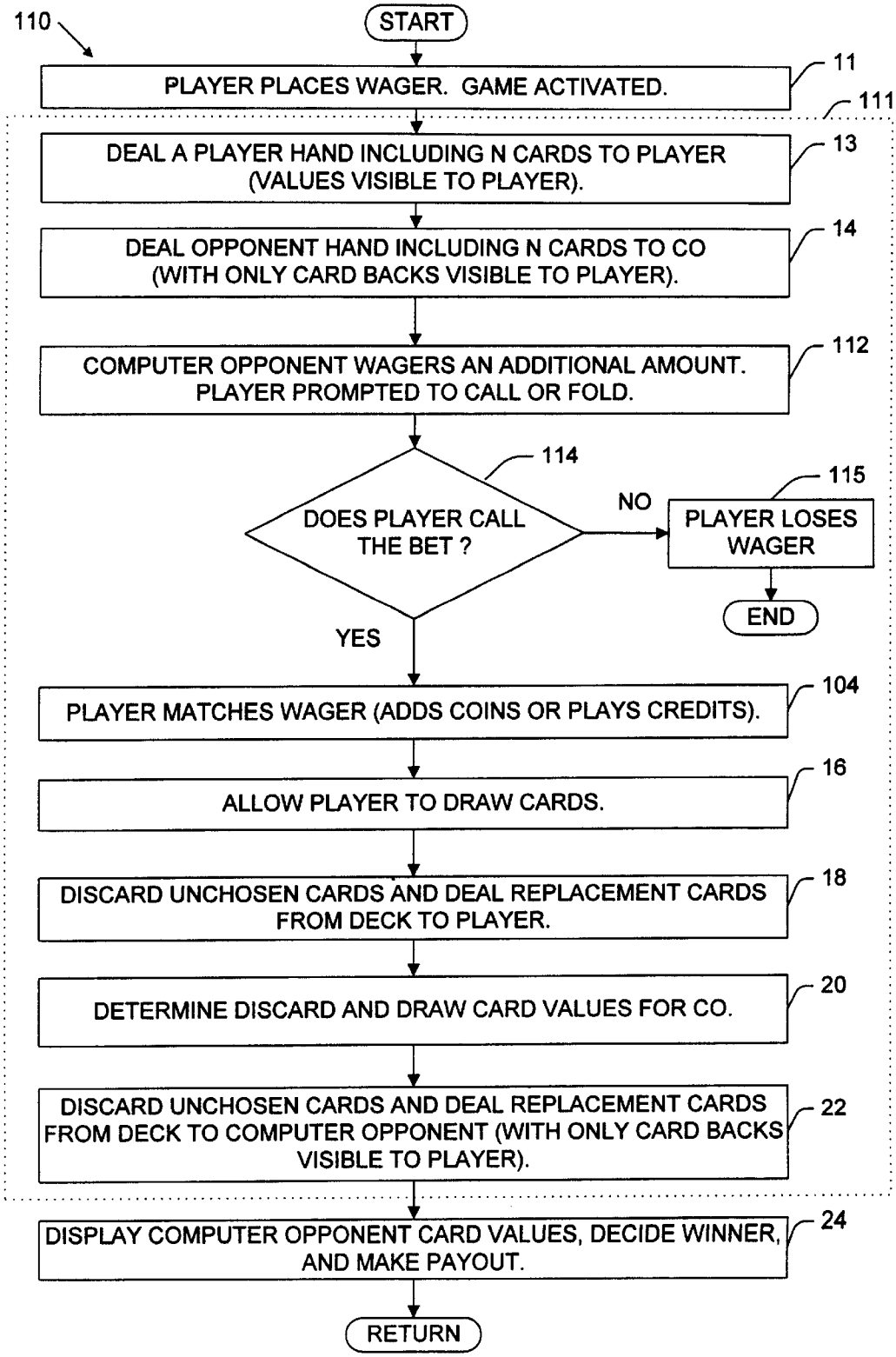
FIG. 7 is a flow chart depicting an electronic card gaming process wherein the player is required to increase the wager before the draw or else must fold and forfeit the wager.

FIG. 7 illustrates at 110 an embodiment wherein the player is required to match opponent's wager before he draws or else he must fold and forfeit the wager. The depicted process begins with execution of step 11 described above and proceeds to implement a core deal sub-process 111. Sub-process 111 begins with execution of steps 13 and 14 in which the player's hand is dealt and the opponent hand is dealt to the computer opponent as described above. In step 112, the computer opponent wagers an original ante amount and the player is prompted, via the display means, to match the bet or fold. It is then determined at 114 whether or not the player wants to match the bet. If the player does not want to match the wager, he forfeits and a new game is started. If the player wants to continue playing, he is required to match the wager by adding coins or applying credits, after which the sub-process 111 proceeds to execute steps 16–22 as described above. After execution of sub-process 111, the depicted process executes step 24 as described above.

Figure 8:
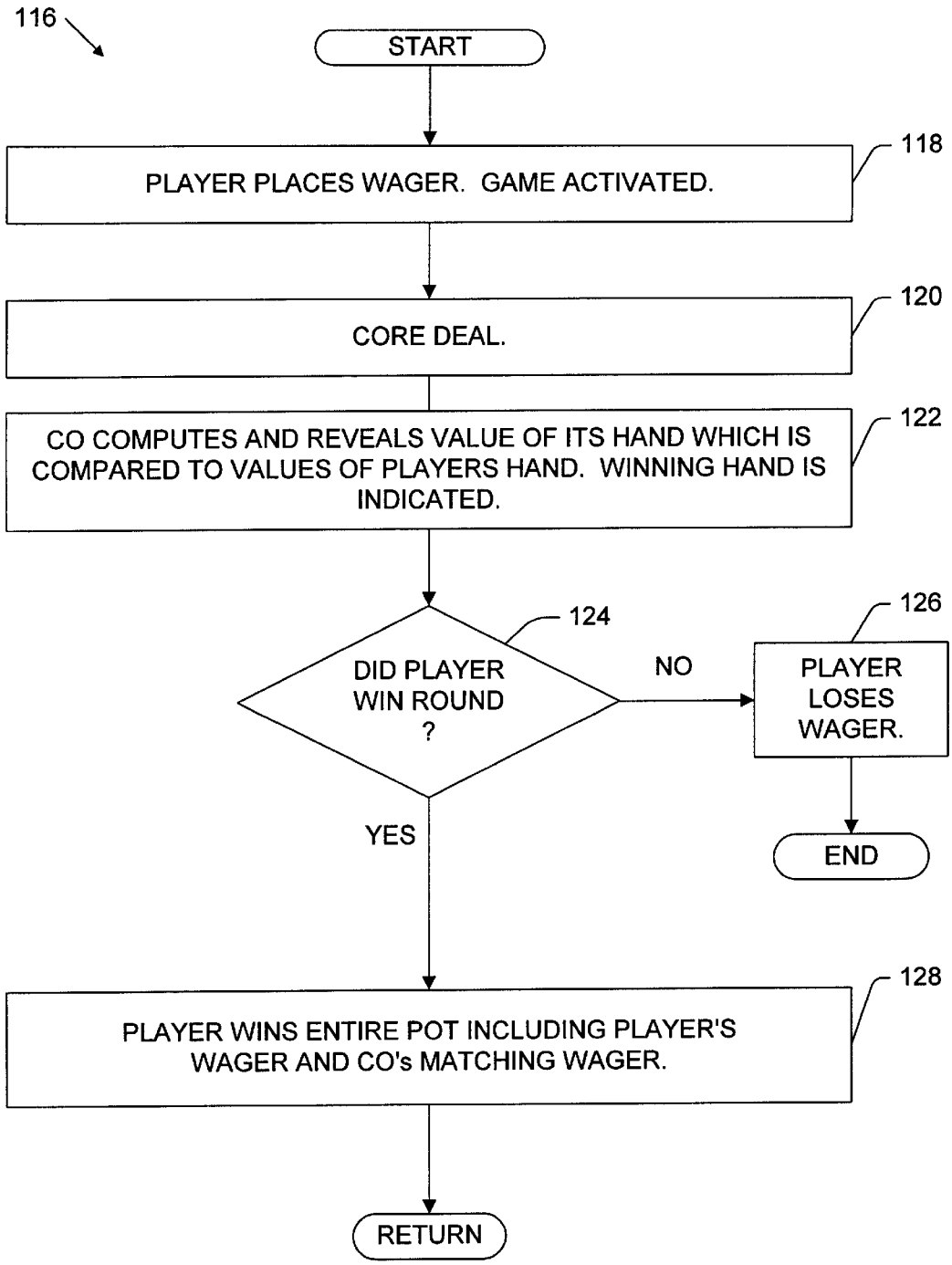
FIG. 8 is a flow chart depicting a basic standalone electronic card gaming process in accordance with the present invention.

FIG. 8 is a flow chart depicting at 116 a basic standalone draw card gaming process according to the present invention. The depicted process begins with step 118 in which the player places a wager and the game is activated. In step 120, a "core deal" sequence is executed wherein the core deal may include any one of the above described processes for dealing and drawing cards including sub-process 12 (FIG. 2A), sub-process 31 (FIG. 2B), sub-process 81 (FIG. 4), sub-process 89 (FIG. 5), sub-process 101 (FIG. 6), or sub-process 111 (FIG. 7). In step 122, the computer opponent's hand is computed as described above and the card values are displayed on the display means. The gaming system then determines and displays who has the winning hand by comparing the player hand to the opponent hand. If it is determined at 124 that the player has won the round, the depicted process proceeds to step 128 in which the player is awarded the entire pot including the player's wager and the computer opponents wager after which the process returns. If the player did not win, he loses the wager and the process returns to START.

Figure 9:
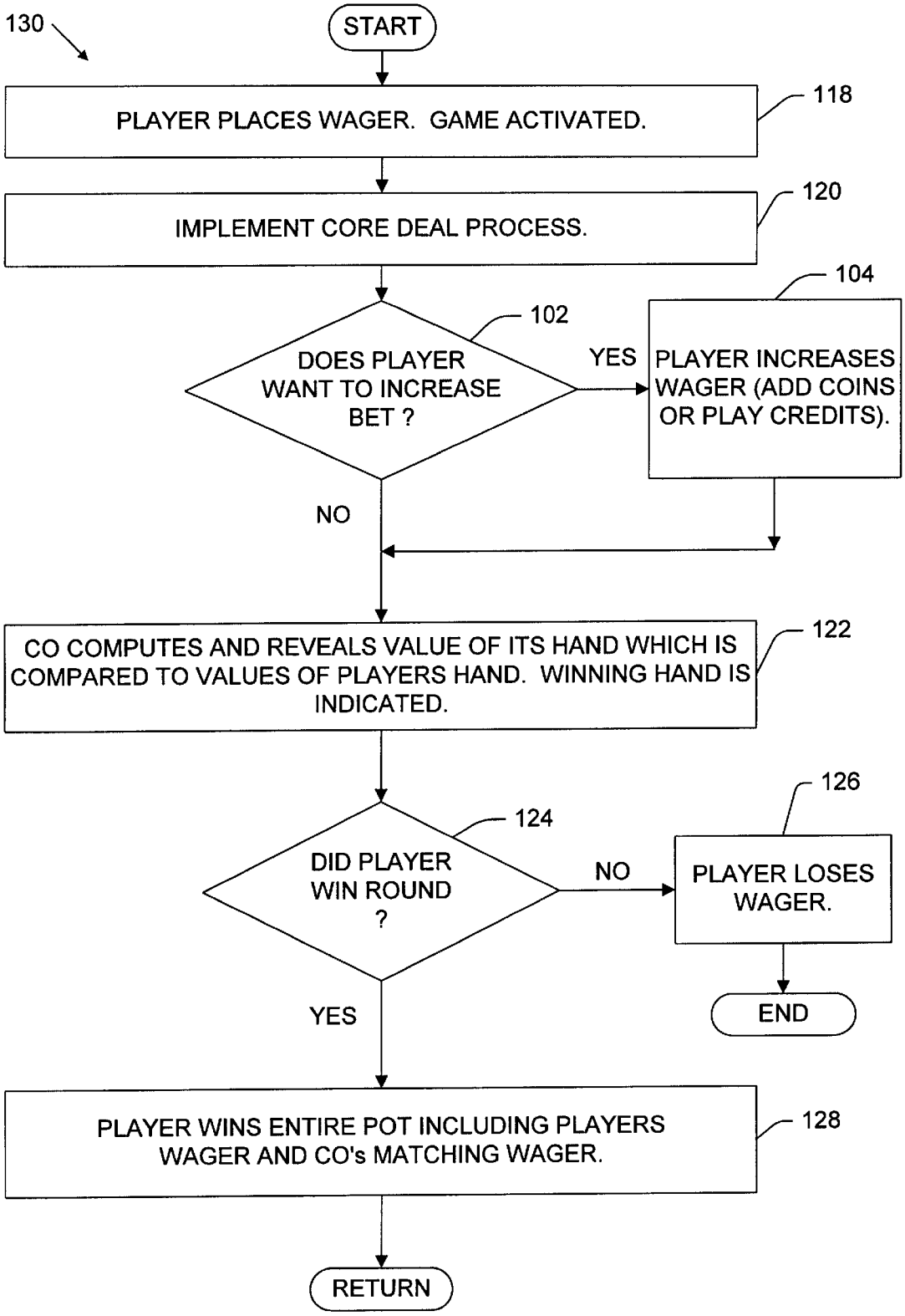
FIG. 9 is a flow chart depicting an electronic card gaming process wherein the player is given an option to increase the wager after the draw.

In the embodiment depicted at 130 of FIG. 9, the player is given an option at 102 to increase the wager after both he and the CO have drawn but before the CO computes and reveals the values of its hand. The depicted process begins with steps 118 and 120 in which the player places a wager, the game is activated, and a core deal process is executed in accordance with the present invention as described above in reference to FIG. 8. Subsequently, it is determined at step 102 whether or not the player wants to increase the wager and, if so, the depicted process proceeds to step 104 in which the gaming system provides for the player to increase the wager, after which the process proceeds to step 122. If the player chooses not to increase the wager, the depicted process proceeds directly to step 122. In step 122, the computer opponent's hand, including the card values, is displayed and the gaming system determines the winning hand as described above. If it is determined at 124 that the player has won the round, the depicted process proceeds to step 128 wherein the player is awarded the entire pot including his wager and the computer opponents wager. Otherwise, the player loses his wager as indicated at step 126 and the depicted process returns to START.

Figure 10:
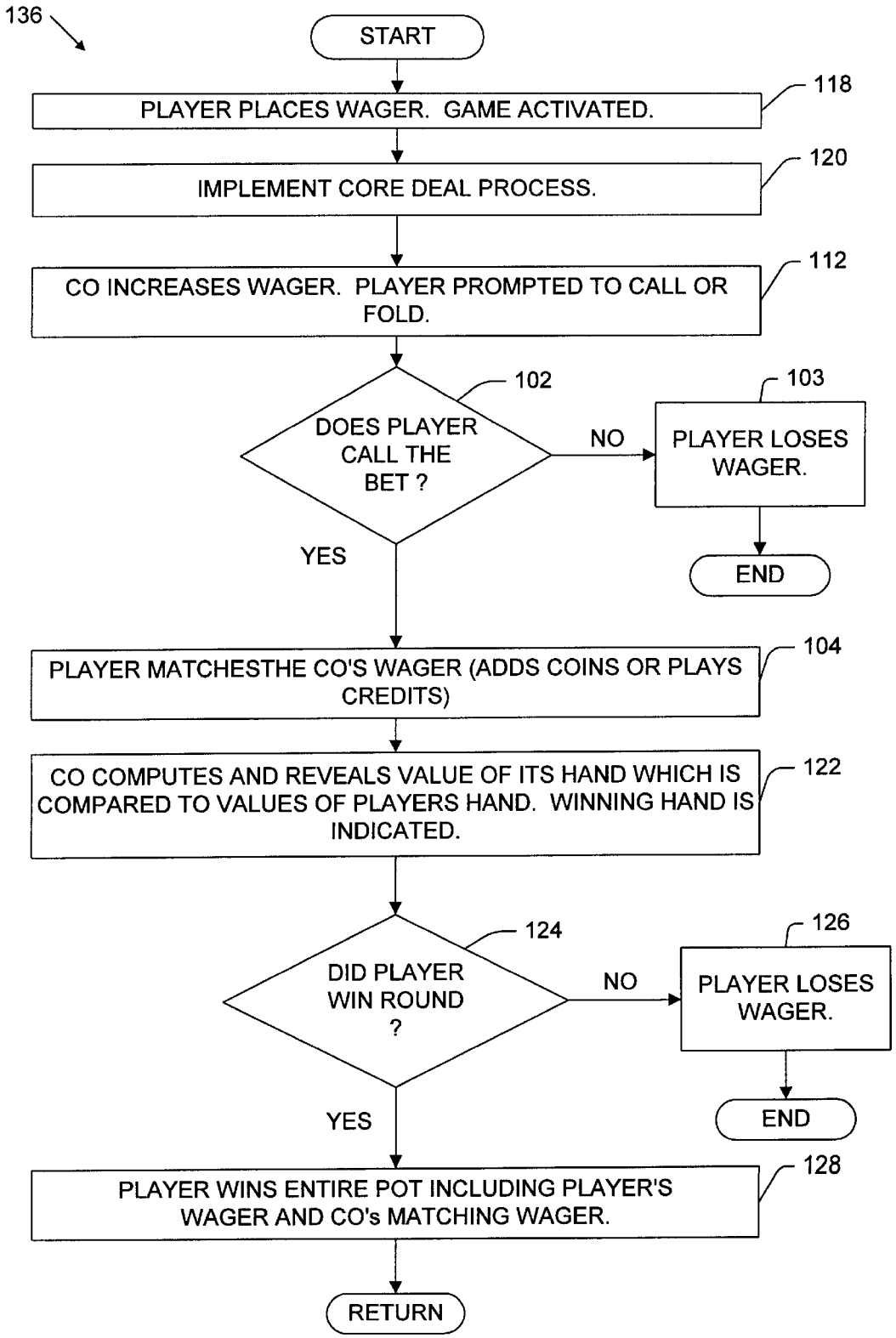
FIG. 10 is a flow chart depicting an electronic card gaming process wherein the player is required to increase the wager after the draw or else must fold and forfeit the wager.

FIG. 10 illustrates an embodiment at 136 wherein the player is required to increase the wager after the draw or else he must fold and forfeit the wager. The depicted process is similar to that depicted at 130 (FIG. 9) except that in this case if it is determined at step 102 that the player does not want to call the computer opponent's bet, the player loses the wager at step 103 and the game is ended.

Figure 11:
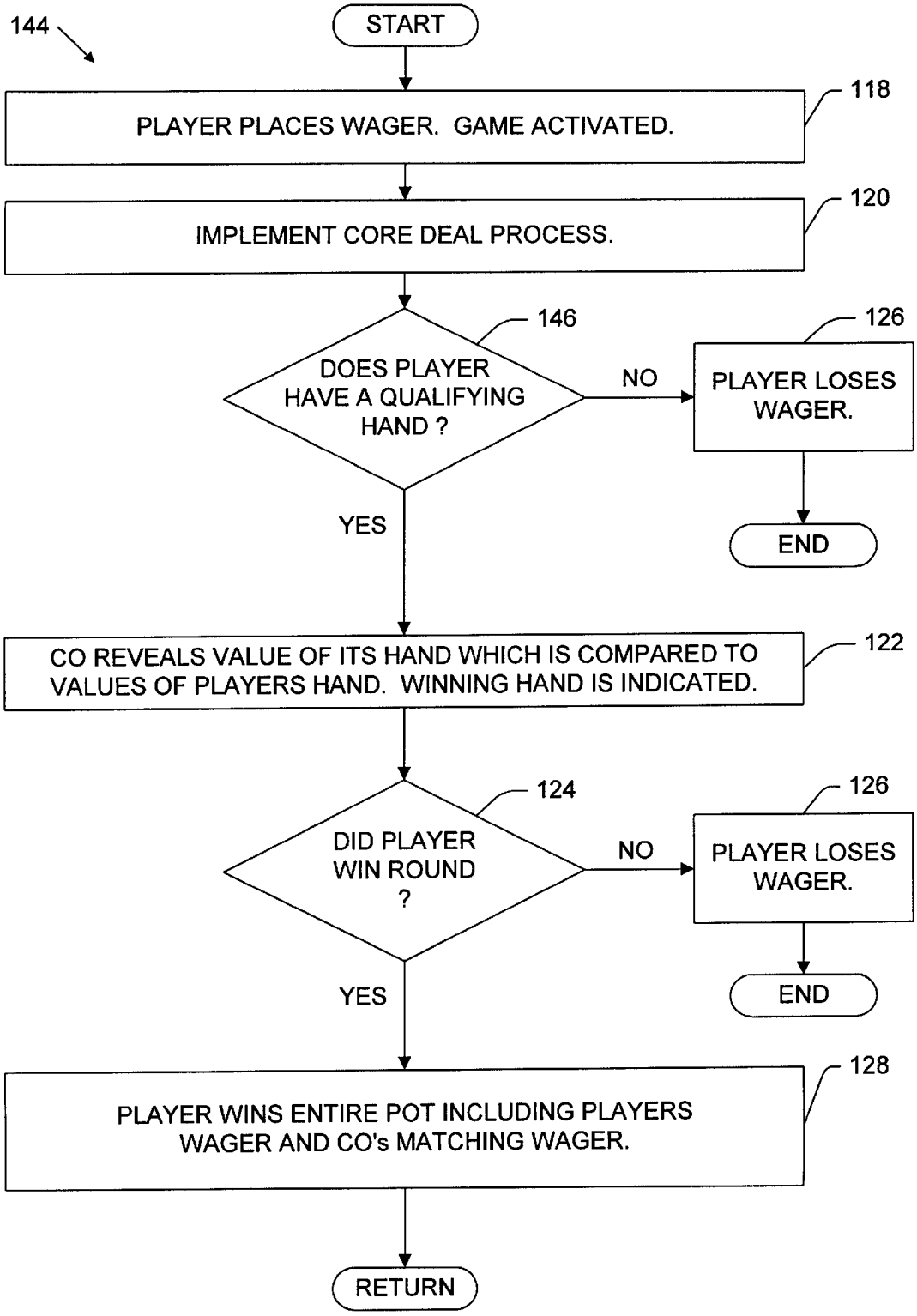
FIG. 11 is a flow chart depicting an electronic card gaming process wherein the player must have a qualifying hand in order for the computer opponent to reveal its hand or else must fold and forfeit the wager.

FIG. 11 illustrates an embodiment at 144 which is similar to the embodiment at 136 (FIG. 10) except that it is determined at 146 whether the player has a qualifying hand in order for the computer opponent to reveal its hand or else the player loses the wager at step 126 and the game ends.

Figure 12:
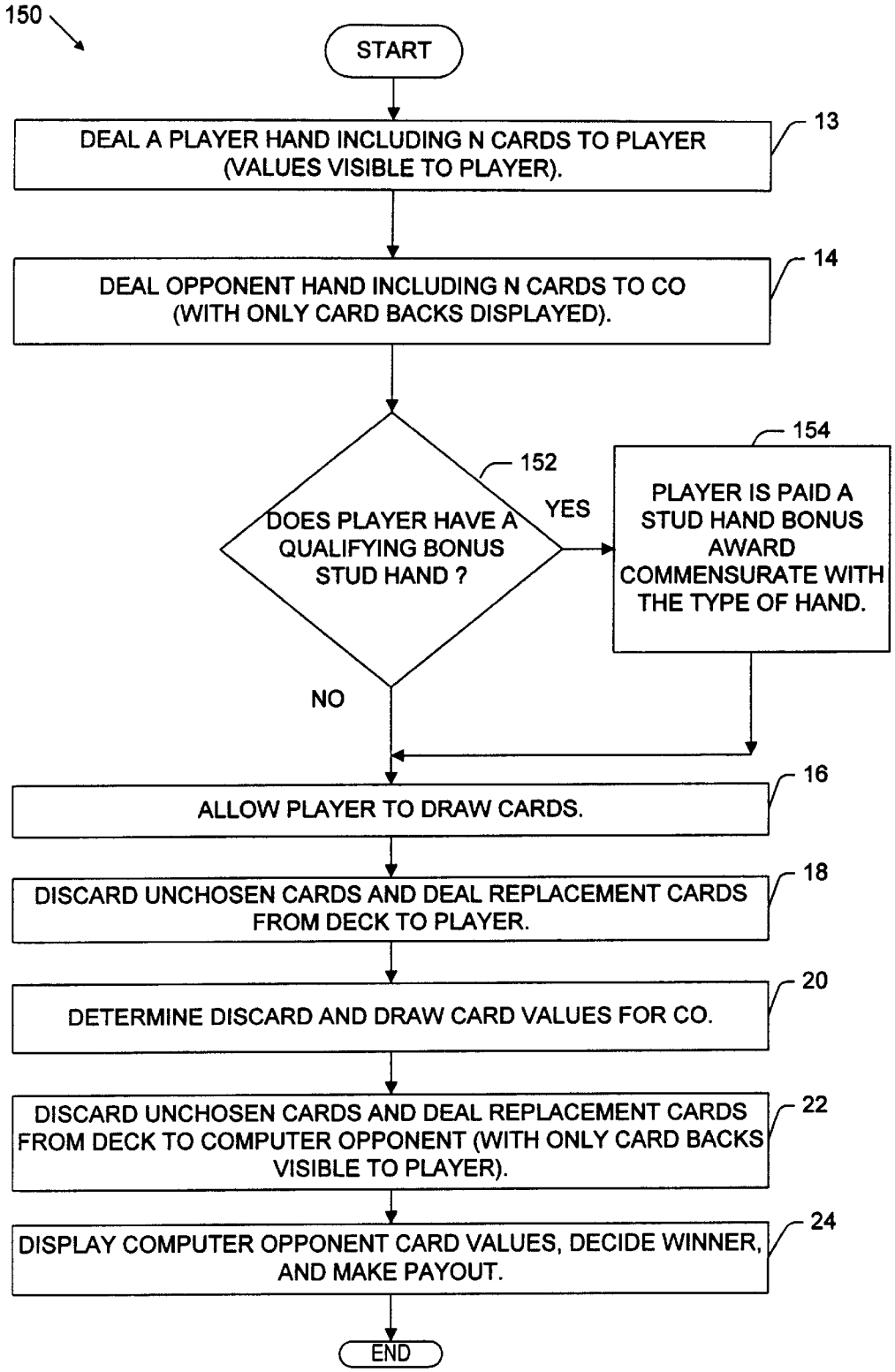
FIG. 12 is a flow chart depicting a an electronic card gaming process wherein the player may get an award bonus if the player's pre-draw hand is of sufficient value.

FIG. 12 discloses a variation of the gaming process at 150 wherein the player may get an award bonus if his pre-draw hand is of sufficient value. The depicted process begins with execution of steps 13 and 14 in which the player hand is dealt to the player and the initial opponent hand is dealt to the computer opponent as described above. It is then determined at 152 whether or not the player has a qualifying bonus stud hand. If so, the process proceeds to step 154 in which the player is paid a stud hand bonus award commensurate with the value of his hand, and after which the process proceeds to execute steps 16–24 as described above. If it is determined in step 152 that the player does not have a qualifying bonus stud hand, the process proceeds directly to execute steps 16–24 as described above.

Figure 13:
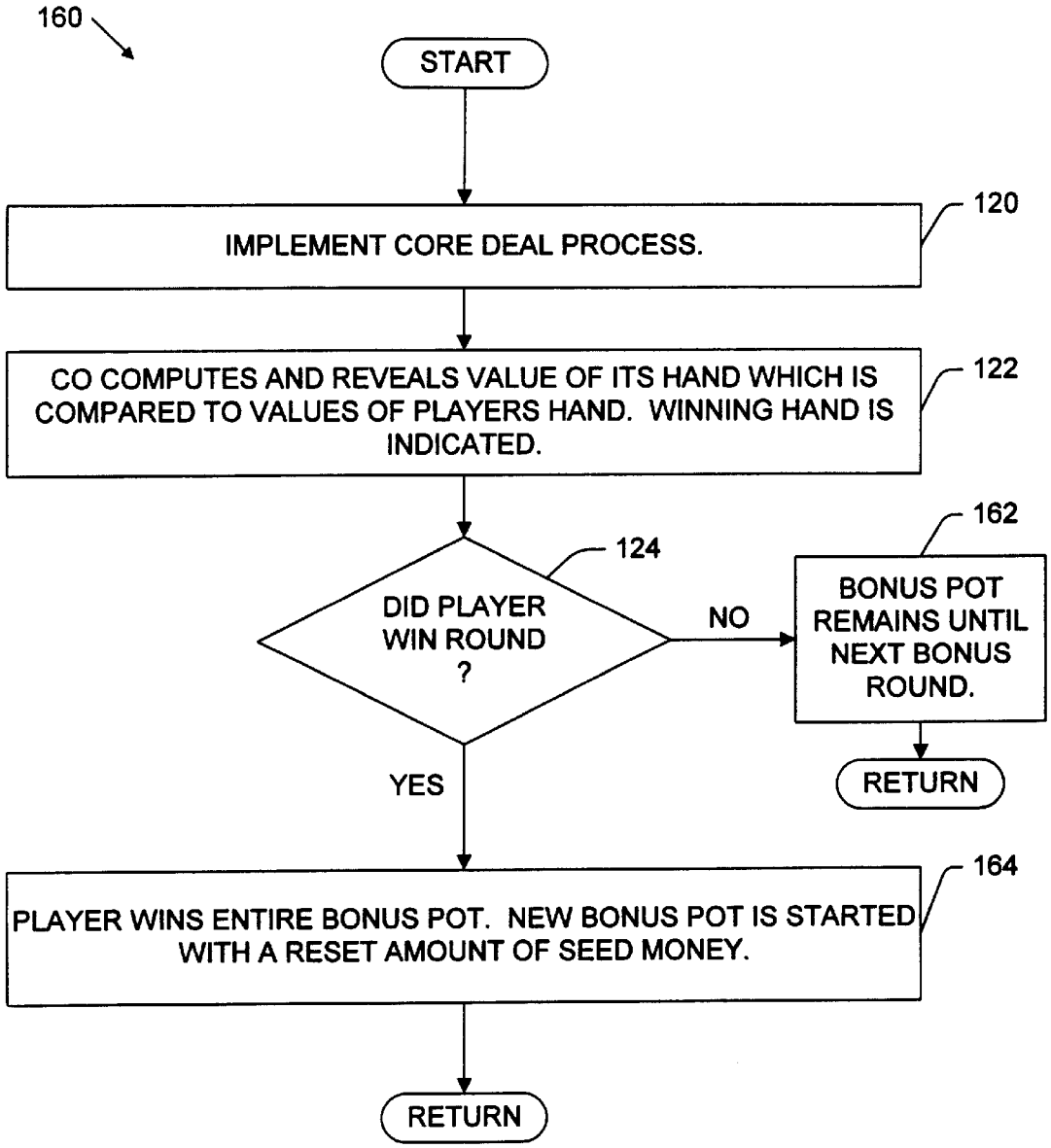
FIG. 13 is a flow chart depicting an electronic card gaming process wherein a bonus pot value is progressively increased.

FIG. 13 indicates at 160 a gaming process in accordance with the present invention wherein a bonus pot value is progressive. The depicted process begins with step 120 in which cards are dealt and drawn in accordance with either steps 13–22 of the sub-process 12 (FIG. 2A) wherein the player draws first, or the sub-process 31 (FIG. 2B) wherein the computer opponent draws first. In step 122, the value of the computer opponent's hand is computed, and the card values are displayed on the display means, and the gaming system determines and displays who has the winning hand by comparing the player's hand to the computer opponent's hand. If it is determined at 124 that the player has won the round, the depicted process proceeds to step 164 in which the player is awarded an entire bonus pot and a new bonus pot is started with a reset amount of seed money. Otherwise, the process proceeds to step 162 in which the bonus pot remains until the next round and the depicted process returns to START.

Figure 14:
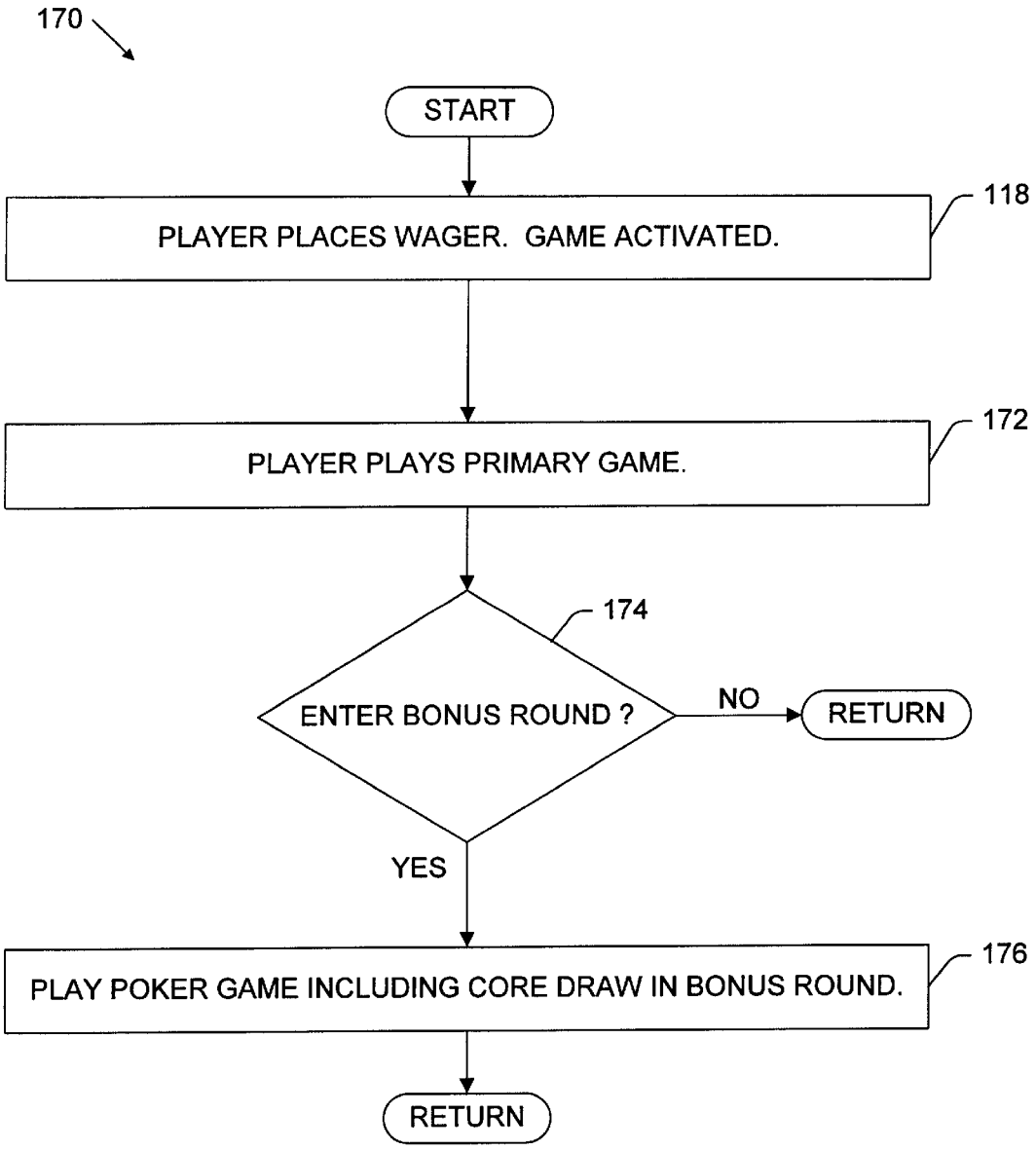
FIG. 14 is a flow chart depicting an electronic card gaming process wherein a player plays draw poker in accordance with the present invention as a bonus round to some other primary game.

FIG. 14 depicts a card game process at 170 wherein a player plays a game of draw poker in accordance with the present invention as a bonus round to some other primary game. The depicted process begins with execution of step 118 in which the player places a wager and the game is activated. In step 172, the player plays a primary electronic game which may be any suitable electronic casino type game such as for example, draw poker. At 174, it is determined whether or not to enter into a bonus round. This determination may be made based on various conditions. In one embodiment, a bonus round may be entered if (1) the wager placed by the player in step 118, above, is greater than a bonus round wager threshold value; and (2) a random number generator outputs a specific value which is known to occur at a particular frequency. If the bonus round is to be entered, the process proceeds to step 176 in which a card game process in accordance with the present invention is played as a bonus round to the primary game played in step 172. In this embodiment, step 176 is implemented by the process depicted at 160 (FIG. 13) wherein the bonus pot value is progressive, as described above.

FIG. 15 is a flow chart depicting a card game process at 180 wherein a bonus round may be entered if a sufficiently large wager is placed by the player. The depicted process begins with step 118 in which the player places a wager and the game is activated. In is then determined at 182 whether or not a bet count is large enough to increase a bonus pot. The bet count is indicative of a number of games previously played and may be equal to the number of games played since a reset condition was met. Alternatively, the bet count may be representative of a count of the total number of coins bet in a number of games previously played since the reset condition was met. The bonus pot and bet count may be shared by a plurality of electronic gaming systems which are communicatively coupled together such as, for example, via a computer network. The bet count may for example be increased based on the number of coins wagered via a selected number of machines which is less then all of the machines coupled together.

If the bet count is determined at step 182 to be large enough to increase the bonus pot, the bet count is reset, the bonus pot is increased, and the process proceeds through steps 172, 174, and 176 as described in reference to the process at 170 (FIG. 14) wherein the player plays a primary game and if it is time for a bonus round, the player may play a bonus round in addition to the primary game played in step 172. Otherwise, the bonus pot is not increased and the process proceeds directly through steps 172, 174, and 176 as in the process at 170 (FIG. 14).

FIG. 16 shows a live card-table system 200 according to an embodiment of the present invention for use in implementing a banked card game played with a physical deck of cards wherein a human dealer, whose play is directed by a computer implemented strategy process, plays against one or more players. Table 200 includes: a plurality of player places 202 each having a player card area 204 into which player cards are dealt, and a wager spot 206; and a dealers place 208 having a dealer card display area 210 and a dealer card read area 212.

The dealer card read area 212 includes a first card reader 214 for reading a first card of the dealers hand, a second card reader 216 for reading a second card of the dealers hand, a third card reader 218 for reading a third card of the dealers hand, a fourth card reader 220 for reading a fourth card of the dealers hand, and a fifth card reader 222 for reading a fifth card of the dealers hand. Each of the card readers 214, 216, 218, 220, and 222 may be implemented using a scanner which is coupled to a computer game system, such as game system 02 (FIG. 1). The game system reads each of the dealer cards and determines which cards to hold and which to discard using the play strategy look-up table described above in reference to FIG. 3.

Table 200 further includes a pair of indicators 224 for each of the card readers 214, 216, 218, 220, and 222. Each pair of indicators 224 is provided in a location adjacent the corresponding card reader and includes a discard indicator 226 and a hold indicator 228 which are used to indicate to the dealer whether to hold or discard the card placed in the corresponding card reader as further explained below. In an embodiment, indicators 226 and 228 are implemented using red and green light emitting diodes respectively.

In operation, when the dealer indicates the close of wagering, only players who have placed a wager will be involved with the current hand. Preferably, cards are dealt to the players in a clockwise fashion. Initially, the dealer deals a first card to each player, placing each player card, face down in the corresponding player card area 204. The dealer then places the dealers first card, face down, on top of the first card reader 214. Likewise, the dealer deals second, third, fourth, and fifth cards to each of the players and to himself in the second, third, fourth, and fifth card readers 216, 218, 220, and 222, respectively. Subsequently, each player discards 0 to K cards by discarding cards from the player hand and placing them in the corresponding player card area 204. The dealer removes discarded cards from the player card areas and deals replacement cards to each player appropriately such that each player again has 5 cards. After the players have drawn cards, the dealer presses a start button 230 which initiates reading of the dealer's cards by the dealer card readers, and which enables the indicators 224 to be activated. The indicators are not activated until after the players have drawn cards.

Adjacent to each dealer's card, either the discard indicator 226 or the hold indicator 228 will be activated. If the discard indicator 226 corresponding to dealer card is activated, the dealer will discard the card into the discard pile without revealing its value. For any card that was discarded, the dealer will deal another card from the deck into its place. The dealer flips over each dealer card and places it into the dealer card display area 210.

Various ones of the processes depicted in FIGS. 2 through 15, and apparatus depicted in FIGS. 1 and 16, may be combined, as suggested above, to implement a card gaming apparatus and process in accordance with the principles of the present invention.

Although the present invention has been particularly shown and described above with reference to a specific embodiment, it is anticipated that alterations and modifications thereof will no doubt become apparent to those skilled in the art. It is therefore intended that the following claims be interpreted as covering all such alterations and modifications as fall within the true spirit and scope of the invention.

What is claimed is:

1. In an electronic card gaming system including processing means, display means, and player interface means, a process of implementing a draw poker game played between a player and a computer opponent, said process comprising the steps of:

(a) dealing an initial player hand including N cards to said player from a computer card deck, each of said cards having a card value, said player hand being displayed on said display means;

(b) dealing an initial opponent hand including N cards to said computer opponent, each of said cards having a card value, an identical card back image being displayed on said display unit for each of said cards;

(c) allowing said player to discard cards from said initial player hand and draw cards from said deck to develop a final player hand;

(d) determining discard opponent cards from said initial opponent hand by addressing a strategy look up table;

(e) drawing cards from said deck for substitution of said discard opponent cards to develop a final opponent hand;

(f) displaying the card values of said final opponent hand;

(g) comparing said final player hand to said final opponent hand to determine a winner; and (h) paying an award to said winner.

2. In an electronic card gaming system as recited in claim 1 wherein said strategy look-up table is addressed using an address set including all possible hands that could be dealt in an N card poker game and wherein each address of said address set stores a corresponding optimal hold scenario.

3. In an electronic card gaming system as recited in claim 1 wherein said strategy look-up table is addressed using an address set including all possible hands that could be dealt in an N card poker game and wherein each address of said address set stores a corresponding sub-optimal hold scenario.

4. In an electronic card gaming system as recited in claim 1, wherein said step (c) of allowing for said player to draw cards includes:

(i) providing means for said player to select and discard throwaway cards from said player hand using said player interface means; and (j) dealing a card to said player from said deck for each of said throwaway cards.

5. In an electronic card gaming system as recited in claim 1, wherein supplementary computer opponents, in addition to said computer opponent, play against said player and including the further steps of repeating said step (b), (d), and (e) for each of said supplementary computer opponents.

6. In an electronic card gaming system as recited in claim 1, further comprising the steps of:

determining whether said player wishes to increase a wager; and provided that said player wishes to increase said wager, providing for said player to increase said wager.

7. In an electronic card gaming system as recited in claim 1, further comprising the steps of:

providing for said player to wager an original ante amount;

raising said wager on behalf of said computer opponent; and determining whether said player calls said raising of said wager.

8. In an electronic card gaming system as recited in claim 1, further comprising the steps of:

providing for said player to place a wager before performing said step (a);

wherein said step (h) of paying an award to the winner includes, if said player has won, awarding to said player a pot including said wager and a matching wager of said computer opponent.

9. In an electronic card gaming system as recited in claim 1, wherein said step (a) of dealing a player hand, and said step (c) of allowing said player to discard and draw cards includes polling a random number generator.

10. In an electronic card gaming system as recited in claim 1, further comprising the step of determining whether said player has a qualifying hand before performing said steps (c), (d), (e) and (f).

11. In an electronic card gaming system as recited in claim 1, further comprising the steps of:

prior to performing said step (c), determining whether said player hand is a qualifying bonus stud hand; and provided that said player hand is a qualifying bonus stud hand, awarding said player a stud hand bonus award.

12. In an electronic card gaming system as recited in claim 1, further comprising the step of:

prior to performing said step (a), providing for said player to place a wager, providing for said player to play a primary electronic game, determining whether said wager is greater than a threshold value, and provided that said wager is greater than a threshold value, providing for said player to play a bonus round including, performing said steps (a) through (f) wherein said step (f) further includes, provided that said player has won, awarding said bonus pot to said player and starting a new bonus pot with a reset amount of seed money.

13. In an electronic card gaming system as recited in claim 8, wherein said step (h) of paying an award to the winner further includes, if said player has not won, increasing said bonus pot.

14. In an electronic card gaming system as recited in claim 1, further comprising the steps of:

determining whether a bet count is greater than a bet count threshold value, said bet count being representative of a number of card games played on said gaming system;

provided that said player has not won and provided that said bet count is greater than said bet count threshold value, increasing said bonus pot and resetting said bet count.

15. A process of creating a play strategy look-up table for use in implementing a draw-poker game strategy in a draw poker game played between a player and a computer opponent, said process comprising the steps of:

determining all possible hands that could be dealt in an N card poker game;

determining all possible hold scenarios for each of said possible hands;

assigning an expected payback value based on optimal play strategy for the game, for each of the hold scenarios;

setting a computer opponent efficiency target value as a percentage of optimal play strategy, said efficiency target value being representative of a level of expertise with which said computer opponent is to play;

determining the hold scenario with a corresponding expected payback value closest to said efficiency target value for each of said possible hands; and creating a look-up table including, for each of said possible hands, a hold scenario closest to said computer opponent efficiency target value.

16. A process of creating a play strategy look-up table as recited in claim 15 wherein a 52 card deck is used, each hand includes N=5 cards, and in which there are 32 possible hold scenarios for each possible hand.

* * * * *